US011731433B2

(12) United States Patent
Kaji et al.

(10) Patent No.: US 11,731,433 B2
(45) Date of Patent: Aug. 22, 2023

(54) THERMAL HEAD AND THERMAL PRINTER

(71) Applicant: KYOCERA CORPORATION, Kyoto (JP)

(72) Inventors: Narito Kaji, Aira (JP); Yosuke Iwamoto, Kirishima (JP); Ryohei Matsubara, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/778,401

(22) PCT Filed: Nov. 19, 2020

(86) PCT No.: PCT/JP2020/043259
§ 371 (c)(1),
(2) Date: May 19, 2022

(87) PCT Pub. No.: WO2021/100822
PCT Pub. Date: May 27, 2021

(65) Prior Publication Data

US 2022/0396081 A1 Dec. 15, 2022

(30) Foreign Application Priority Data

Nov. 22, 2019 (JP) ..... 2019-211866

(51) Int. Cl.
*B41J 2/335* (2006.01)
*B41J 2/345* (2006.01)

(52) U.S. Cl.
CPC ..... *B41J 2/335* (2013.01); *B41J 2/345* (2013.01)

(58) Field of Classification Search
CPC ..... B41J 2/335; B41J 2/345
See application file for complete search history.

(56) References Cited

U.S. PATENT DOCUMENTS

2005/0219349 A1* 10/2005 Takeya ..... B41J 2/3359 347/204
2018/0354265 A1* 12/2018 Aoki ..... B41J 2/33535

FOREIGN PATENT DOCUMENTS

EP 1582359 A2 * 10/2005 ..... B41J 2/335
JP H6-17939 U 3/1994
JP 2014188682 A * 10/2014 ..... B41J 2/335

* cited by examiner

*Primary Examiner* — Yaovi M Ameh
(74) *Attorney, Agent, or Firm* — Hauptman Ham, LLP

(57) ABSTRACT

A thermal head includes a head base, a wiring board, a plurality of recessed portions, a contact portion, a plurality of drive ICs, a plurality of wire members, and a resin member. The head base includes a substrate. The wiring board is located adjacent to the head base. The plurality of recessed portions are located adjacent to the head base. The contact portion is located between the recessed portions adjacent to each other, and the substrate and the wiring board are in contact with each other at the contact portion. The plurality of drive ICs are located on the first surface of the wiring board so as to face one by one the plurality of recessed portions. The plurality of wire members are located across the recessed portions and electrically connect the substrate and the drive ICs. The resin member seals the plurality of wire members and the plurality of drive ICs.

12 Claims, 8 Drawing Sheets

THERMAL HEAD AND THERMAL PRINTER

CROSS-REFERENCE TO RELATED APPLICATIONS

This application is national stage application of International Application No. PCT/JP2020/043259, filed on Nov. 19, 2020, which designates the United States, and which claims the benefit of priority from Japanese Patent Application No. 2019-211866, filed on Nov. 22, 2019.

TECHNICAL FIELD

Embodiments of the present disclosure relate to a thermal head and a thermal printer.

BACKGROUND ART

Conventionally, various thermal heads have been proposed as printing devices such as facsimile machines and video printers. For example, there is known a thermal head in which a head substrate and a wiring board being in contact with each other are connected by wires and sealed with an insulating resin member. Further, in order to reduce the generation of air bubbles at the time of curing the resin member, there is disclosed a structure in which portions other than both end portions on a contact side of the wiring board in contact with the head substrate are cut off (see Patent Document 1, for example).

CITATION LIST

Patent Literature

Patent Document 1: JP 06-17939 UM-A

SUMMARY OF INVENTION

A thermal head according to an aspect of an embodiment includes a head base, a wiring board, a plurality of recessed portions, a contact portion, a plurality of drive ICs, a plurality of wire members, and a resin member. The head base includes a substrate. The wiring board is located adjacent to the head base. The plurality of recessed portions are located adjacent to the head base. The contact portion is located between the recessed portions adjacent to each other, and the substrate and the wiring board are in contact with each other at the contact portion. The plurality of drive ICs are located on a first surface of the wiring board so as to face one by one the plurality of recessed portions. The plurality of wire members are located across the recessed portions and electrically connect the substrate and the drive ICs. The resin member seals the plurality of wire members and the plurality of drive ICs.

DESCRIPTION OF EMBODIMENTS

Embodiments of a thermal head and a thermal printer disclosed in the present application will be described below with reference to the accompanying drawings. Note that the present invention is not limited to the embodiments that will be described below.

First Embodiment

Thermal Head

Figure 1:
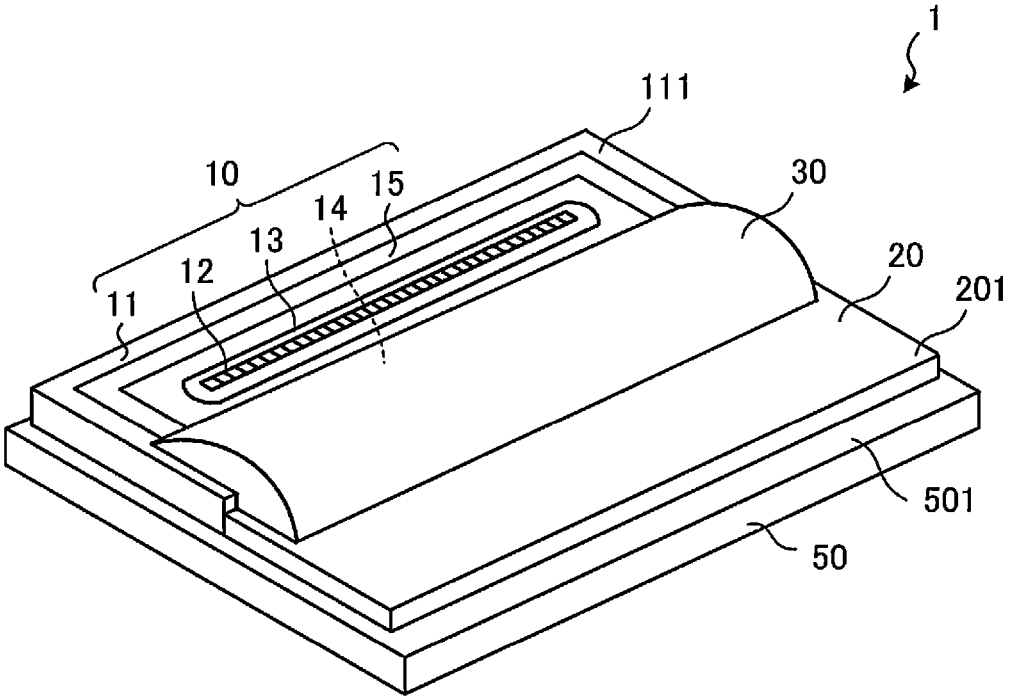
FIG. 1 is a perspective view of a thermal head according to a first embodiment.

FIG. 1 is a perspective view illustrating a configuration of a thermal head 1 according to a first embodiment.

The thermal head 1 according to the first embodiment includes a head base 10, a wiring board 20, a resin member 30, and a heat dissipation plate 50, as illustrated in FIG. 1. The head base 10 includes a substrate 11, a heat generating unit 12, a heat storage layer 13, a plurality of individual electrodes 14, and a common electrode 15.

The head base 10 has a substantially rectangular parallelepiped shape that is wide in the arrangement direction of the heat generating unit 12. Each member constituting the thermal head 1 is provided on a first surface 111 that is a front surface of the substrate 11. The head base 10 has a function of printing on a recording medium (not illustrated) in accordance with electrical signals supplied from the outside.

The substrate 11 has a substantially rectangular parallelepiped shape and is made of an electrically insulating material such as an alumina ceramic or a semiconductor material such as monocrystalline silicon.

The heat storage layer 13 is located on the first surface 111 of the substrate 11 along a longitudinal direction (hereinafter may be referred to as a "first direction") of the substrate 11. The heat storage layer 13 is made of a material such as a glass having low thermal conductivity and has a function of temporarily storing part of heat generated by the heat generating unit 12. Thus, the time required to raise the temperature of the heat generating unit 12 can be shortened, and the heat storage layer 13 functions to enhance the thermal response characteristics of the thermal head 1. The heat storage layer 13 is formed by, for example, applying a predetermined glass paste, which is obtained by mixing a glass powder with an appropriate organic solvent, onto the first surface 111 of the substrate 11 by common well-known screen printing or the like, and firing the glass paste.

The heat generating unit 12 is located on the heat storage layer 13. A plurality of elements constituting the heat generating unit 12 are arranged along the longitudinal direction of the substrate 11. The heat generating unit 12 has a function of generating heat in accordance with electrical signals supplied from the outside to print on a recording medium (not illustrated). The plurality of elements constituting the heat generating unit 12 are disposed at a density of, for example, 100 dpi to 2400 dpi (dots per inch).

The heat generating unit 12 includes an electric resistance layer having a relatively high electric resistance, such as a TaN-based layer, a TaSiO-based layer, a TaSiNO-based layer, a TiSiO-based layer, a TiSiCO-based layer, or a NbSiO-based layer. The electric resistance layer is located between the individual electrode 14 and the common electrode 15. When a voltage is applied to the electric resistance layer, the electric resistance layer generates heat by Joule heating.

The plurality of individual electrodes 14 are located side by side on one side of the heat generating unit 12 on a first surface 111 side of the substrate 11. The plurality of individual electrodes 14 are individually connected to the elements of the heat generating unit 12 one by one. The common electrode 15 is located on the first surface 111 of the substrate 11 so as to surround the remaining three sides of the heat generating unit 12. The common electrode 15 is commonly connected to all of the elements of the heat generating unit 12. The individual electrode 14 and the common electrode 15 are made of, for example, a metal such as Cu or Al. Details of the individual electrode 14 and the common electrode 15 will be described later.

The wiring board 20 has a plate shape that is wide in the arrangement direction of the heat generating unit 12. The wiring board 20 is located adjacent to the head base 10 on a side where the individual electrode 14 of the head base 10 is disposed. The wiring board 20 is electrically connected to drive ICs (not illustrated) and is electrically connected to the outside via a connector (not illustrated). The wiring board 20 is, for example, a rigid printed wiring board having a high rigidity. Details of the drive IC will be described later.

The resin member 30 is located from the wiring board 20 to the head base 10. The resin member 30 is located across the first surface 111 of the substrate 11 located on a first surface 501 which is a front surface of the heat dissipation plate 50 and a first surface 201 which is a front surface of the wiring board 20, and seals the drive ICs (not illustrated) and the like located on the first surface 201. Details of the resin member 30 will be described later.

The heat dissipation plate 50 is located on a back surface side of the substrate 11 and on a back surface side of the wiring board 20. The heat dissipation plate 50 is, for example, a metal plate made of Cu, Al, or stainless steel. The heat dissipation plate 50 has a function of dissipating excess heat generated on the substrate 11 and on the wiring board 20 to the outside.

Figure 2:
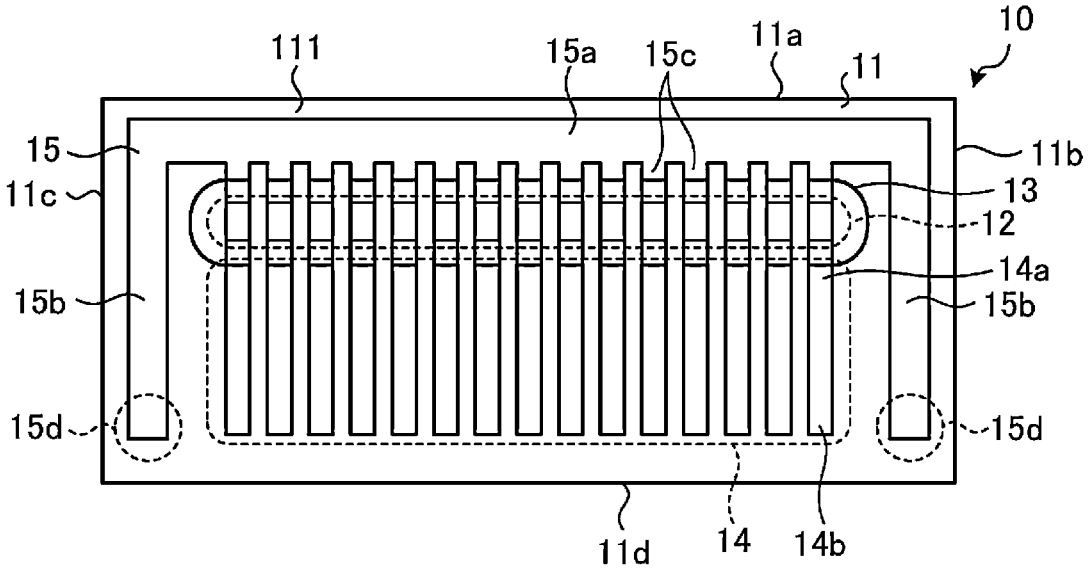
FIG. 2 is a plan view of a head base according to the first embodiment.

Next, details of the individual electrode 14 and the common electrode 15 will be described. FIG. 2 is a plan view of the head base 10 according to the first embodiment. The plurality of individual electrodes 14 are located on the first surface 111 side of the substrate 11, and is arranged along the arrangement direction of the heat generating unit 12. The individual electrode 14 includes one end 14*a* and the other end 14*b*. The one end 14*a* is electrically connected to the element of the heat generating unit 12. The other end 14*b* is electrically connected to the drive IC (not illustrated) located on the first surface 201 (see FIG. 1) of the wiring board 20 via a wire (not illustrated). Details of the individual electrode 14 will be described later.

The common electrode 15 electrically connects each element of the heat generating unit 12 and the connector (not illustrated). The common electrode 15 includes a main wiring portion 15*a*, sub wiring portions 15*b*, and lead portions 15*c*. The main wiring portion 15*a* extends along one long side 11*a* of the substrate 11. The sub wiring portions 15*b* extend along each of one short side 11*b* and the other short side 11*c* of the substrate 11. The lead portions 15*c* individually extend from the main wiring portion 15*a* toward elements of the heat generating unit 12. The common electrode 15 is electrically connected to the connector (not illustrated) located on the wiring board 20 via wires (not illustrated) from end portions 15*d*. The common electrode 15 is located so as to surround the remaining three sides of the heat generating unit 12 excluding the other long side 11*d* side of the substrate 11 on which the individual electrodes 14 are disposed. The long side 11*d* is located adjacent to the wiring board 20. Note that the individual electrodes 14 and the common electrode 15 in FIG. 2 are schematically illustrated as an example and do not necessarily correspond to actual shapes.

Figure 3:
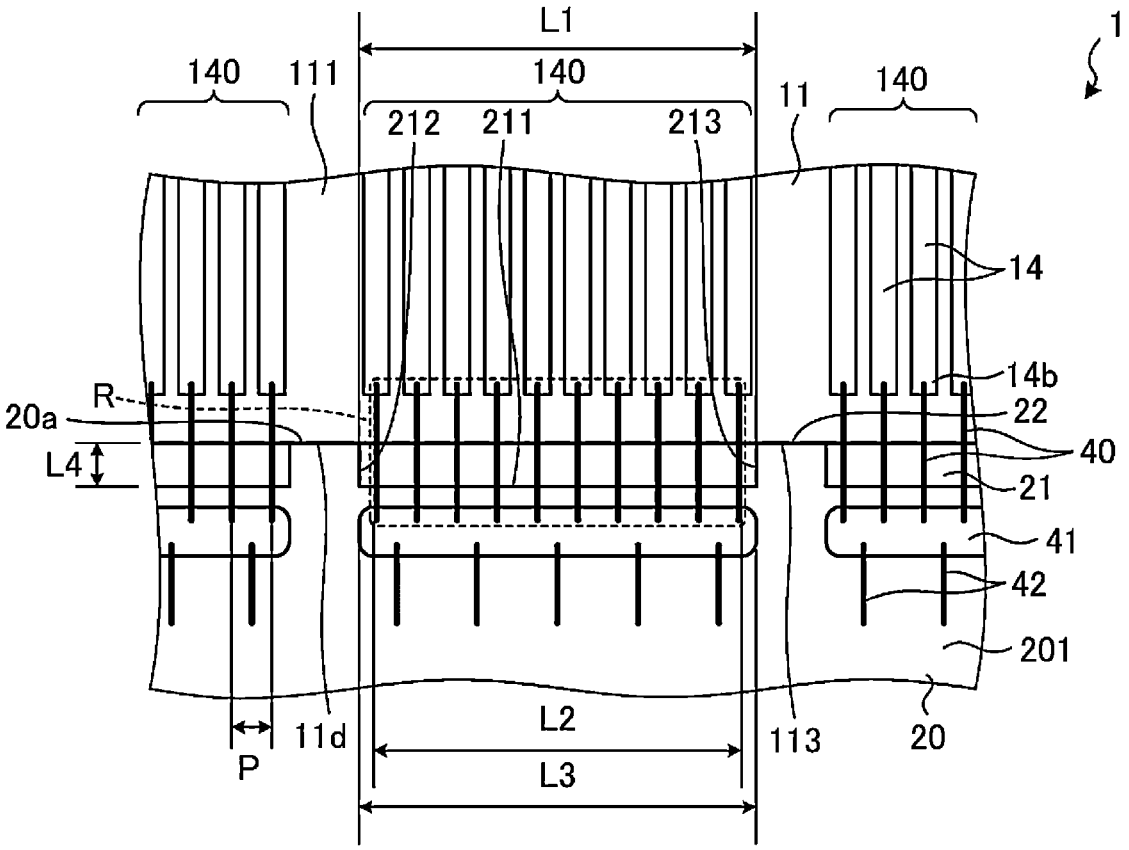
FIG. 3 is a plan view illustrating a main part of the thermal head according to the first embodiment.
Figure 4:
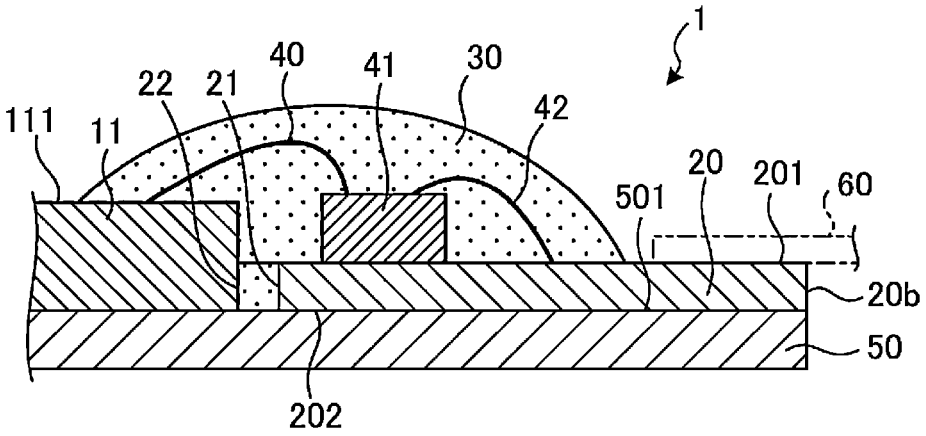
FIG. 4 is a cross-sectional view illustrating the main part of the thermal head according to the first embodiment.

Next, a specific configuration of the thermal head 1 according to the first embodiment will be further described with reference to FIGS. 3 and 4. FIG. 3 is a plan view illustrating a main part of the thermal head 1 according to the first embodiment. FIG. 4 is a cross-sectional view illustrating the main part of the thermal head 1 according to the first embodiment. In FIG. 3, illustration of the resin member 30 is omitted.

The thermal head 1 includes a plurality of individual electrode groups 140, a plurality of drive ICs 41, a plurality of first wires 40, and a plurality of second wires 42.

Each of the plurality of individual electrode groups 140 includes a plurality of individual electrodes 14. Each of the individual electrodes 14 belonging to the individual electrode group 140 is electrically connected to the corresponding drive IC 41 via the first wire 40. The first wire 40 is an example of the wire member. In FIG. 3, ten individual electrodes 14 are belonging to the individual electrode group 140, but the number of the individual electrodes 14 is not limited to ten and can be appropriately set.

The plurality of drive ICs 41 are located along the first direction that is the arrangement direction of the heat generating unit 12 (see FIGS. 1 and 2). Each of the plurality of drive ICs 41 is located facing a corresponding individual electrode group 140. The drive IC 41 is electrically connected to the other end 14*b* of the individual electrode 14 on the substrate 11 via the first wire 40. The drive IC 41 is also electrically connected to a terminal (not illustrated) located on the first surface 201 of the wiring board 20 via the second wire 42.

The drive IC 41 receives electrical signals supplied from the outside via the wiring board 20 and the second wire 42 electrically connected to the wiring board 20. The drive IC 41 supplies power to the heat generating unit 12 (see FIGS. 1 and 2) in accordance with received electrical signals to selectively cause each element of the heat generating unit 12 to generate heat.

The plurality of first wires 40 each electrically connect the drive IC 41 and the individual electrodes 14 belonging to the individual electrode group 140 corresponding to the drive IC 41. The plurality of second wires 42 electrically connect the drive IC 41 and terminals (not illustrated) located on the first surface 201 of the wiring board 20. The first wire 40 and the second wire 42 are bonding wires made of a metal such as Cu, Au, Al, and the like.

An interval P between the first wires 40 connected to the individual electrodes 14 belonging to the individual electrode group 140 may be, for example, 80 μm or less, or particularly 50 μm or more and 75 μm or less. By adjusting the interval P between the first wires 40 in this manner, it is possible to downsize the thermal head 1 while ensuring a desired insulating property.

The thermal head 1 further includes a plurality of recessed portions 21, a contact portion 22, and a connector 60.

The plurality of recessed portions 21 are arranged side by side so as to face an end surface 113 of the substrate 11 on which the long side 11*d* of the substrate 11 is located. Each of the plurality of recessed portions 21 is located so as to be sandwiched between the individual electrode group 140 on the substrate 11 and the drive IC 41 on the wiring board 20. The plurality of recessed portions 21 are grooves formed by cutting out one end 20*a* of the wiring board 20 located facing the end surface 113. Further, the plurality of recessed portions 21 penetrate from the first surface 201 of the wiring board 20 to a second surface 202 that is a back surface of the wiring board 20. In this manner, the plurality of first wires 40 connecting the individual electrodes 14 and the drive IC 41 are located across the recessed portion 21.

The contact portion 22 is located between the recessed portions 21 adjacent to each other. The contact portion 22 is the one end 20*a* of the wiring board 20 that is in contact with the end surface 113. In other words, the recessed portion 21 and the contact portion 22 are alternately located on the one end 20*a* of the wiring board 20.

The connector 60 is located on the other end 20*b* side of the wiring board 20 located opposite to the one end 20*a* close to the substrate 11. The connector 60 is electrically connected to the wiring board 20 and is electrically connected to the outside. A flexible flat cable (not illustrated) electrically connecting the connector 60 and the wiring board 20 may be located between the connector 60 and the wiring board 20.

Here, sealing of the thermal head 1 using the resin member 30 will be described. The resin member 30 covers all the drive ICs 41 located on the wiring board 20. The resin member 30 is, for example, a silicone resin or an epoxy resin. The resin member 30 seals the drive ICs 41, the first wires 40, the second wires 42, and the like in a state in which the first wires 40 and the second wires 42 are connected to the drive ICs 41. The resin member 30 seals all regions illustrated in FIG. 3.

The resin member 30 is obtained by sealing a predetermined portion using a resin material having fluidity and then curing the resin material. When the first wires 40 having a smaller interval P than the second wires 42 and the vicinity of the first wires 40 are sealed using the resin material, air bubbles are likely to be trapped in the resin material. In addition, some of the trapped air bubbles cannot be completely removed even after curing and may cause a crater-like depression on the surface of the resin member 30 or remain inside the resin member 30 as voids. The depression or voids generated in the resin member 30 as described above may cause performance failure such as an insufficient resistance value, in addition to an appearance defect.

In the thermal head 1 according to the first embodiment, the plurality of first wires 40 are located across the plurality of recessed portions 21 located between the substrate 11 and the wiring board 20. First, the resin material for sealing the plurality of first wires 40 and the vicinity thereof is accumulated in a space defined by the first surface 501 of the heat dissipation plate 50, side surfaces 211 to 213 of the recessed portion 21, and the end surface 113. Then, the resin material is further accumulated to a predetermined height so as to cover the plurality of first wires 40 located on the wiring board 20 and on the substrate 11 and then cured. When the resin material is accumulated in order from the heat dissipation plate 50 side in this manner, air bubbles are less likely to be trapped even when the resin material reach the height of the first wires 40. Thus, in the thermal head 1 according to the first embodiment, it is possible to reduce the occurrence of failures due to the sealing using the resin member 30 such as entrapment of air bubbles into the resin material in the process of sealing the first wires 40 using the resin material and subsequent depression and voids of the resin member 30.

In addition, the thermal head 1 according to the first embodiment includes the contact portion 22 located between the recessed portions 21 adjacent to each other, and the substrate 11 and the wiring board 20 are in contact with each other at the contact portion 22. Accordingly, the plurality of recessed portions 21 in which the resin material is accumulated are located only in areas overlapping in a plan view with the plurality of first wires 40 where the entrapment of air bubbles is likely to occur. Thus, according to the thermal head 1 according to the first embodiment an increase in the usage amount of the resin member 30 can be reduced.

In addition, in the thermal head 1 according to the first embodiment, the contact portion 22 is located between the drive ICs 41 adjacent to each other and all of the recessed portions 21 facing the corresponding drive ICs 41. Thus, in the thermal head 1 according to the first embodiment, it is possible to uniformly seal all the drive ICs 41 and the plurality of first wires 40 connected thereto using the resin material, and reduce the occurrence of failures due to the sealing by the resin member 30.

In addition, a length L1 of the recessed portion 21 along the first direction along which the plurality of recessed portions 21 are arranged can be larger than a width L2 along the first direction of a region R where the plurality of first wires 40 are located in a plan view. As a result, even when the recessed portion 21 and the plurality of first wires 40, overlapping overlap the region R in a plan view, are sealed, the resin material can be entered from the side of the region R instead of from the plurality of first wires 40 where the entrapment of air bubbles is likely to occur. Thus, the thermal head 1 according to the first embodiment can reduce the occurrence of failures due to the sealing by the resin member 30.

The length L1 of the recessed portion 21 can be smaller than a length L3 of the drive IC 41 along the first direction. This makes it possible to suppress an increase in the usage amount of the resin member 30. Further, it is possible to reduce the occurrence of failures such as exposure of the first wire 40 from the resin member 30.

Further, a length L4 of the recessed portion 21 in a second direction intersecting the first direction may be, for example, 50 μm or more and 200 μm or less, or further 80 μm or more and 100 μm or less. In one example, the length L4 may be 100 μm. When the length L4 is less than 50 μm, it may be difficult for the resin material to enter the recessed portion 21, and appropriate sealing using the resin member 30 may not be achieved. On the other hand, when the length L4 exceeds 200 μm, the usage amount of the resin member 30 may be increased.

The surface roughness of the side surfaces 211 to 213 of the recessed portion 21 may be larger than the surface roughness of the contact portion 22. As a result, in the contact portion 22, for example, the substrate 11 and the wiring board 20 can be accurately aligned, the resin material that has entered the recessed portion 21 can be less likely to flow out of the recessed portion 21, and appropriate sealing using the resin member 30 can be achieved.

Further, the surface roughness of the side surfaces 211 to 213 of the recessed portions 21 may be larger than the surface roughness of the first surface 201 of the wiring board 20. As a result, the resin material having flowed to the first surface 201 of the wiring board 20 can easily enter the recessed portion 21, and the resin material having entered into the recessed portion 21 can be less likely to flow out of the recessed portion 21. Thus, appropriate sealing using the resin member 30 can be achieved.

Here, the magnitude of the surface roughness of the side surfaces 211 to 213, the contact portion 22, and the first surface 201 can be determined based on the arithmetic mean roughness Ra and the maximum height roughness Rz, defined in JIS B0633; 2001. The arithmetic mean roughness Ra and the maximum height roughness Rz can be measured, for example, by measuring in a sub scanning direction using a contact type or a non-contact type surface roughness meter. For example, when there is no significant difference in values of either of the arithmetic mean roughness Ra or the maximum height roughness Rz, the magnitude of the surface roughness can be determined in accordance with values of the other.

Moreover, the surface roughness of the side surfaces 211 to 213 is a value obtained by weighted averaging the measured values of the side surfaces 211 to 213 in accordance with the length L1 of the side surface 211 in the first direction and the length L4 of the side surfaces 212 and 213 in the second direction intersecting the first direction.

Modified Example

The relationship between the length L1 of the recessed portion 21 and the length L3 of the drive IC 41 along the first direction is not limited to that described above. That is, the length L1 of the recessed portion 21 may be larger than the length L3 of the drive IC 41. This makes it possible to reduce the occurrence of failures due to the sealing using the resin member 30.

Thermal Printer

Figure 5:
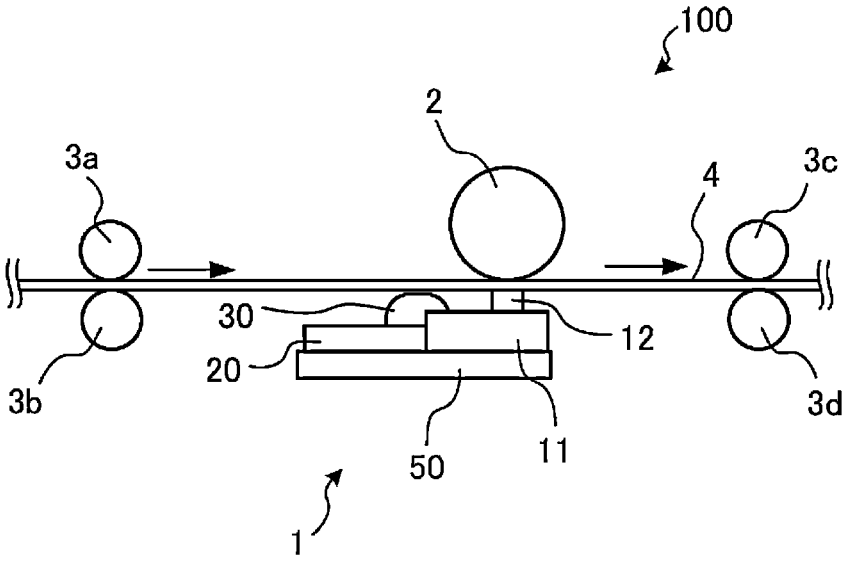
FIG. 5 is a schematic view of the thermal printer according to the first embodiment.

Next, a thermal printer 100 according to the first embodiment will be described with reference to FIG. 5. FIG. 5 is a schematic view of the thermal printer 100 according to the first embodiment.

The thermal printer 100 according to the first embodiment includes the thermal head 1, a platen roller 2, and a transport mechanism. Note that the thermal head 1 is attached to a housing (not illustrated) in a manner such that the arrangement direction of the heat generating unit 12 is along a main scanning direction that is a direction orthogonal to a transport direction of a recording paper 4 that is a recording medium.

The transport mechanism includes a drive unit (not illustrated) and transport rollers 3*a* to 3*d*. The transport mechanism transports the recording paper 4 in an arrow direction illustrated in FIG. 5 onto the heat generating unit 12 of the thermal head 1. The drive unit has a function of driving the transport rollers 3*a* to 3*d*. The drive unit may include, for example, a motor. The transport rollers 3*a* to 3*d* may be made, for example, by covering a shaft body having a cylindrical shape and made of a metal such as stainless steel, using an elastic member made of butadiene rubber or the like.

The platen roller 2 presses the recording paper 4 onto the heat generating unit 12 of the thermal head 1. The platen roller 2 is located so as to extend in a direction (the main scanning direction) orthogonal to the transport direction of the recording paper 4, and both end portions are supported and fixed to be rotatable in a state in which the recording paper 4 is pressed onto the heat generating unit 12. The platen roller 2 may be made, for example, by covering a cylindrical shaft body made of a metal such as stainless steel or the like, with an elastic member made of butadiene rubber or the like.

As illustrated in FIG. 5, the thermal printer 100 selectively causes respective elements of the heat generating unit 12 to generate heat while pressing the recording paper 4 onto the heat generating unit 12 of the thermal head 1 using the platen roller 2 and transporting the recording paper 4 onto the heat generating unit 12 by the transport mechanism. By the series of operations described above, the thermal printer 100 performs predetermined printing on the recording paper 4.

Second Embodiment

Figure 6:
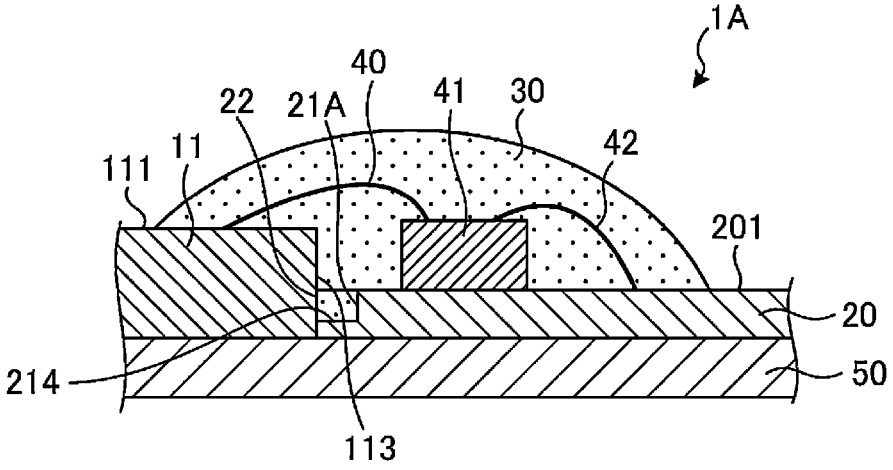
FIG. 6 is a cross-sectional view illustrating a main part of a thermal head according to a second embodiment.

FIG. 6 is a perspective view illustrating a configuration of a thermal head 1A according to a second embodiment.

As illustrated in FIG. 6, the thermal head 1A according to the second embodiment differs from the thermal head 1 according to the first embodiment in that, in the thermal head 1A, a plurality of recessed portions 21A include bottom surfaces 214 so as to be bottomed openings in which a first surface 201 side of a wiring board 20 is open, while the thermal head 1 includes the plurality of recessed portions 21 that penetrate through the wiring board 20 in a thickness direction.

First, a resin material for sealing a plurality of first wires 40 and the vicinity thereof is accumulated in a space defined by the bottom surface 214 of the recessed portion 21A, side surfaces 211 to 213 of the recessed portion 21, and the end surface 113 (see FIG. 3). Then, the resin material is further accumulated to a predetermined height so as to cover the plurality of first wires 40 located on the wiring board 20 and on a substrate 11 and then cured. Thus, in the thermal head 1A according to the second embodiment, an increase in the usage amount of the resin member 30 can be further reduced as compared to the thermal head 1 including the plurality of recessed portions 21 that penetrate through the wiring board 20 in the thickness direction.

Third Embodiment

Figure 7:
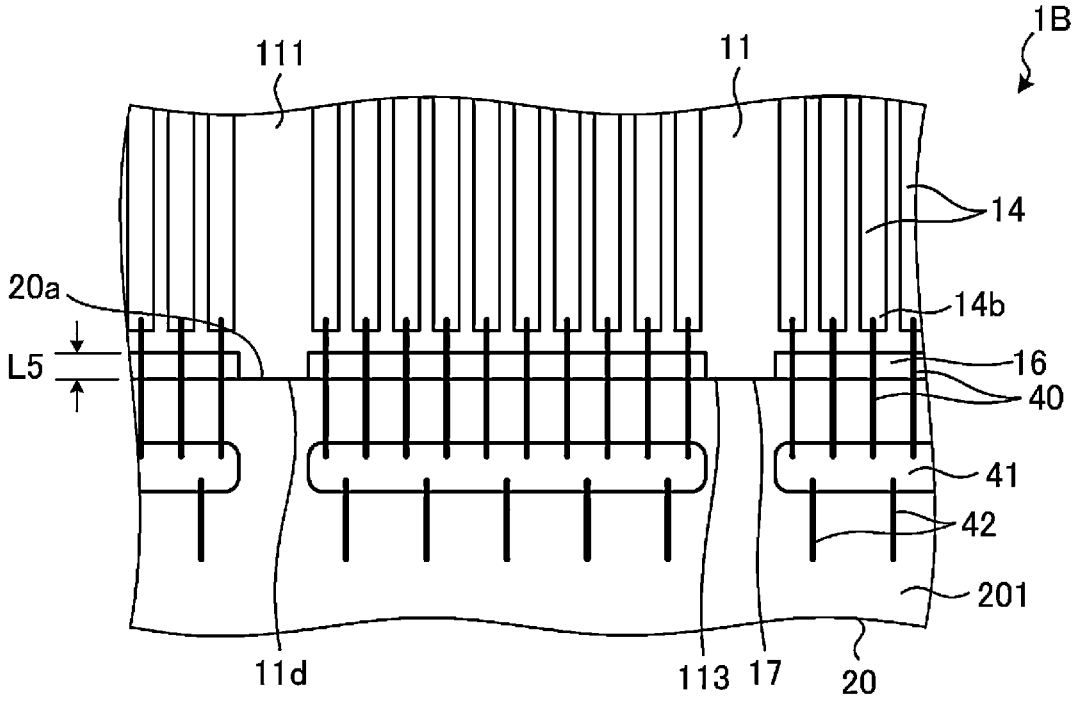
FIG. 7 is a plan view illustrating a main part of a thermal head according to a third embodiment.
Figure 8:
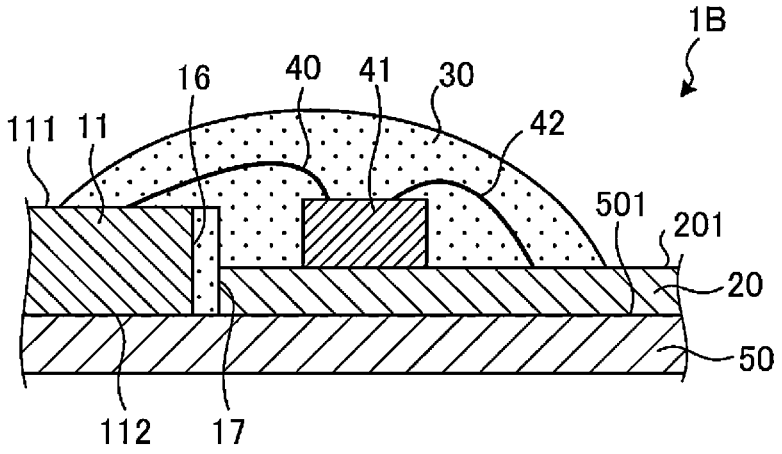
FIG. 8 is a cross-sectional view illustrating a main part of a thermal head according to a third embodiment.

FIG. 7 is a plan view illustrating a main part of a thermal head 1B according to a third embodiment. FIG. 8 is a cross-sectional view illustrating the main part of the thermal head 1B according to the third embodiment.

As illustrated in FIGS. 7 and 8, the thermal head 1B according to the third embodiment differs from the thermal heads 1 and 1A in that a plurality of recessed portions 16 and a contact portion 17 are located on an end surface 113 side of a substrate 11.

The plurality of recessed portions 16 are located so as to face one end 20*a* of a wiring board 20. The plurality of recessed portions 16 are grooves that penetrate from a first surface 111 to a second surface 112 of the substrate 11 so as to cut out the end surface 113 of the substrate 11 located facing the one end 20*a*.

In addition, the contact portion 17 is located between the recessed portions 16 adjacent to each other. The contact portion 17 is the end surface 113 of the substrate 11 that is in contact with the one end 20*a* of the wiring board 20. That is, the recessed portion 16 and the contact portion 17 are alternately located on the end surface 113 of the substrate 11.

First, a resin material for sealing a plurality of first wires 40 and the vicinity thereof is accumulated in a space defined by a first surface 501 of a heat dissipation plate 50, the recessed portion 16, and the one end 20*a*. Then, the resin material is further accumulated to a predetermined height so as to cover the plurality of first wires 40 located on the wiring board 20 and on the substrate 11 and then cured. Thus, in the thermal head 1B according to the third embodiment, it is possible to reduce the occurrence of entrapment of air bubbles into the resin material in the process of sealing the first wires 40 using the resin material and subsequent failures due to the sealing using the resin member 30.

In addition, the thermal head 1B according to the third embodiment includes a contact portion 17 located between the recessed portions 16 adjacent to each other, and the substrate 11 and the wiring board 20 are in contact with each other at the contact portion 17. Accordingly, the plurality of recessed portions 16 in which the resin material is accumulated are located only in areas overlapping in a plan view with the plurality of first wires 40 where the entrapment of air bubbles is likely to occur. Thus, according to the thermal head 1B according to the third embodiment, an increase in the usage amount of the resin member 30 can be suppressed.

A length L5 of the recessed portion 16 in a second direction intersecting a first direction may be, for example, 50 μm or more and 200 μm or less, or further 80 μm or more and 100 μm or less. In one example, the length L5 may be 100 μm. When the length L5 is less than 50 μm, it may be difficult for the resin material to enter the recessed portion 16, and appropriate sealing using the resin member 30 may not be achieved. On the other hand, when the length L5 exceeds 200 μm, the usage amount of the resin member 30 may be increased.

Embodiments according to the present invention were described above. However, the present invention is not limited to the embodiments described above, and various modifications can be made without departing from the essential spirit of the present invention. For example, although the thermal printer 100 including the thermal head 1 according to the first embodiment has been described, the present invention is not limited thereto, and the thermal head 1A or 1B according to other embodiments may be included in the thermal printer 100. In addition, the thermal heads 1 to 1B according to the plurality of embodiments may be combined.

In each of the embodiments described above, it has been described that either of the substrate 11 or the wiring board 20 includes the plurality of recessed portions and the contact portions, but the present invention is not limited thereto, and both of the substrate 11 and the wiring board 20 may include the plurality of recessed portions and the contact portions.

As described above, the thermal head 1 (1A, 1B) according to the embodiments includes the head base 10, the wiring board 20, the plurality of recessed portions 21 (21A, 16), the contact portions 17, the plurality of drive ICs 41, and the plurality of wire members (first wires 40), and the resin member 30. The head base 10 includes the substrate 11. The wiring board 20 is located adjacent to the head base 10. The plurality of recessed portions 21 are located adjacent to the head base 10. The contact portion 17 is located between the recessed portions 21 adjacent to each other, and the substrate 11 and the wiring board 20 are in contact with each other at the contact portion 17. The plurality of drive ICs 41 are located on the first surface 201 of the wiring board 20 so as to face one by one the plurality of recessed portions 21. The plurality of wire members (first wires 40) are located across the recessed portions 21 and electrically connect the substrate 11 and the drive ICs 41. The resin member 30 seals the plurality of wire members (first wires 40) and the plurality of drive ICs 41. Thus, the thermal head 1 (1A, 1B) according to the embodiments can reduce the occurrence of failures due to the sealing using the resin member 30 while suppressing the usage amount of the resin member 30.

Additional effects and variations can be easily derived by a person skilled in the art. Thus, a wide variety of aspects of the present invention are not limited to the specific details and representative embodiments represented and described above. Accordingly, various changes are possible without departing from the spirit or scope of the general inventive concepts defined by the appended claims and their equivalents.

REFERENCE SIGNS LIST

1, 1A, 1B Thermal head
10 Head base
11 Substrate
12 Heat generating unit
13 Heat storage layer
14 Individual electrode
15 Common electrode
16 Recessed portion
17 Contact portion
20 Wiring board
21, 21A Recessed portion
22 Contact portion
30 Resin member
40 First wire
41 Drive IC
42 Second wire
50 Heat dissipation plate
60 Connector
100 Thermal printer

The invention claimed is:

1. A thermal head, comprising:
a head base comprising a substrate;
a wiring board located adjacent to the head base;
a plurality of recessed portions located between the substrate and the wiring board;
a contact portion located between adjacent recessed portions of the plurality of recessed portions, the contact portion being configured to come into contact with the substrate and the wiring board;
a plurality of drive ICs located on a first surface of the wiring board to face a corresponding each recessed portion of the plurality of recessed portions;
a plurality of wire members located across the plurality of recessed portions, the plurality of wire members being configured to electrically connect the substrate and the plurality of drive ICs; and
a resin member configured to seal the plurality of wire members and the plurality of drive ICs.

2. The thermal head according to claim 1, wherein
the contact portion is located between adjacent drive ICs of the plurality of drive ICs and all recessed portions of the plurality of recessed portions facing a corresponding drive IC of the plurality of drive ICs.

3. The thermal head according to claim 1, wherein
a length of each recessed portion of the plurality of recessed portions along a first direction along which the plurality of recessed portions are arranged is larger than a width along the first direction of a region where the plurality of wire members are located, in a plan view.

4. The thermal head according to claim 1, wherein
a length of each recessed portion of the plurality of recessed portions along a first direction along which the plurality of recessed portions are arranged is smaller than a length of each drive IC of the plurality of drive ICs along the first direction.

5. The thermal head according to claim 1, wherein
a length of each recessed portion of the plurality of recessed portions along a first direction along which the plurality of recessed portions are arranged is larger than a length of each drive IC of the plurality of drive ICs along the first direction.

6. The thermal head according to claim 1, wherein
the plurality of recessed portions are located on the wiring board and face the substrate, and a surface roughness of side surfaces of each recessed portion of the plurality of recessed portions is larger than a surface roughness of the contact portion.

7. The thermal head according to claim 1, wherein the plurality of recessed portions are located on the wiring board and face the substrate, and a surface roughness of side surfaces of each recessed portion of the recessed portions is larger than a surface roughness of the first surface.

8. The thermal head according to claim 1, wherein the plurality of recessed portions penetrate through the wiring board in a thickness direction.

9. The thermal head according to claim 1, wherein each recessed portion of the plurality of recessed portions has a bottom surface and an opening in the first surface of the wiring board.

10. The thermal head according to claim 1, wherein the plurality of recessed portions penetrate through the substrate in a thickness direction.

11. The thermal head according to claim 1, further comprising a heat dissipation plate comprising the substrate and the wiring board located on a first surface of the heat dissipation plate.

12. A thermal printer, comprising:

the thermal head according to claim 1;

a transport mechanism configured to transport a recording medium onto a heat generating unit provided on the substrate; and a platen roller configured to press the recording medium onto the heat generating unit.

* * * * *